US005186228A

United States Patent [19]

Stafford

[11] Patent Number: 5,186,228

[45] Date of Patent: Feb. 16, 1993

[54] WORKBENCH AND MOUNTABLE IMPLEMENTS

[76] Inventor: Donald C. Stafford, 414 N. Quincy, Hinsdale, Ill. 60521

[21] Appl. No.: 652,798

[22] Filed: Feb. 8, 1991

[51] Int. Cl.[5] ..... B25H 1/00

[52] U.S. Cl. ..... 144/286 R; 144/286 A; 144/308; 269/45; 269/88; 269/94; 269/99; 269/247; 269/250; 269/253; 269/900

[58] Field of Search ..... 269/45, 88, 91, 94, 269/99, 246, 250, 252, 253, 247, 249, 309, 900, 901; 144/306, 307, 308, 286 R, 286 A

[56] References Cited

U.S. PATENT DOCUMENTS 613,535 11/1898 Toles ..... 144/308
1,164,507 6/1930 Danielson ..... 144/306
2,883,184 4/1959 Brewington ..... 269/91
4,186,784 2/1980 Stone ..... 144/286 A
4,527,786 7/1985 Hsu ..... 289/16

*Primary Examiner*—W. Donald Bray
*Attorney, Agent, or Firm*—Lee, Mann, Smith, McWilliams, Sweeney & Ohlson

[57] ABSTRACT

A workbench including a work top which is supported by a base. The base includes a plurality of attachment points of which various implements such as clamps, brackets and other accesories are removably mountable such that they are secured to the workbench without requiring attachment to the work top, thereby enabling the work top to remain unmarred, imperforate and in good working condition. The plurality of attachment points allow the implements to be mounted to the base in various positions as desired.

21 Claims, 7 Drawing Sheets

FIG. 8
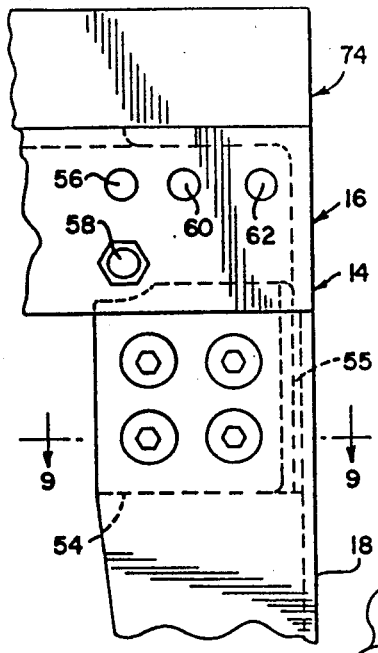
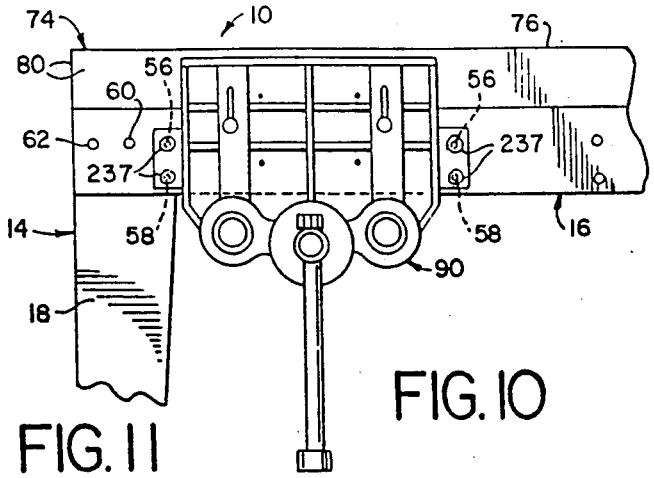
FIG. 10
FIG. 11
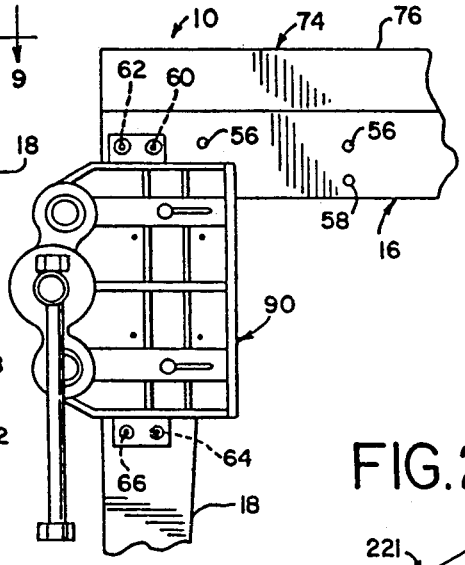
FIG. 21
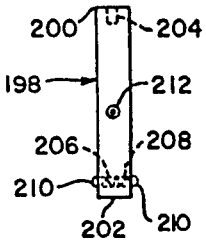
FIG. 9
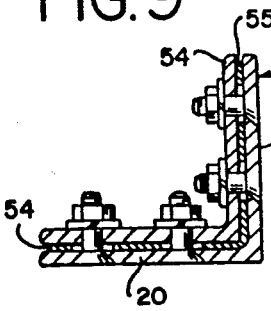
FIG. 22
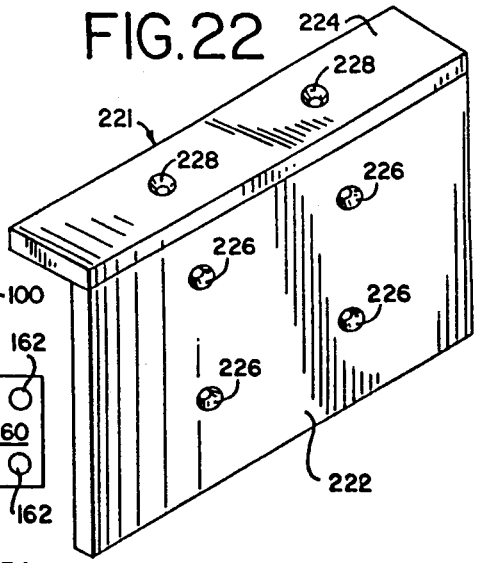
FIG. 12
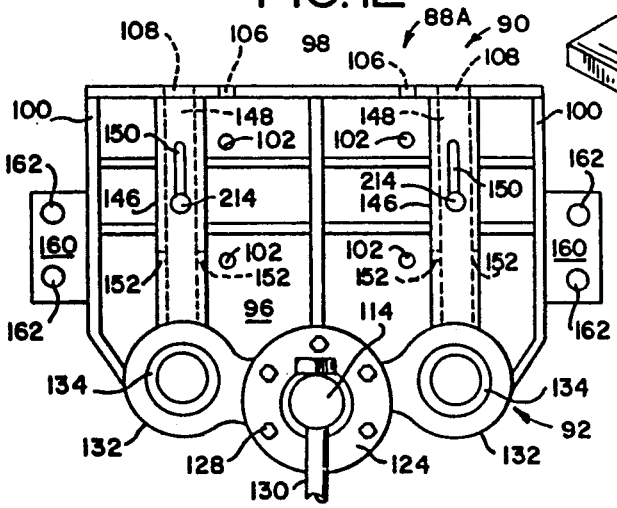

WORKBENCH AND MOUNTABLE IMPLEMENTS

BACKGROUND OF THE INVENTION

The present invention relates to workbenches and associated implements such as vises, clamps, brackets, stops and tool troughs which may be attached to a workbench, and in particular to a workbench wherein the implements may be removably mounted to the workbench in many different locations without requiring any holes, slots, or mortises to be cut into the working surface of the bench.

Workbenches generally include a work top having a work surface which is supported by a base structure. To provide and maintain a good work surface, the work surface must be kept flat, smooth and imperforate. Prior workbenches and the implements used in connection with the workbenches have required that the implements be attached to the work top thereby impairing the condition of the work surface. Some implements such as the clamp shown in U.S. Pat. No. 14,522 require that the clamp be screwed directly into the work top. The implements and work tops shown in U.S. Pat. Nos. 2,661,783; 2,764,195 and 2,888,052 require that the implements be mounted or attached to the work top through the use of countersunk recesses or bores which extend through the work top. The implements and work tops shown in U.S. Pat. Nos. 1,093,554; 1,159,199; 4,413,819 and 4,470,586 require that the implements be attached to the work top through the use of a slot which extends through the work top and the work surface. In addition, to further preserve the condition of the work surface, the work surface should not be used as a backup for drilling holes or for chopping. Neither should jigs or other fixtures, which are often used in repetitive operations, be nailed or screwed to the work top.

As the particular operations to be performed in connection with a workbench will vary from project to project, it is also important that the various types of implements used with the bench be easily mounted to the bench in various locations as desired. The present invention overcomes these problems and provides a workbench to which various useful implements may be mounted in a variety of locations without requiring direct connection to the work top, thereby preserving the condition of the work surface.

SUMMARY OF THE INVENTION

The present invention provides a workbench having a work top, a base structure and a variety of implements such as clamps, vises, and brackets for use in connection with the workbench. The top of the workbench is supported above the floor by the base structure. The base includes a stand and frame. The frame is attached to the bottom of the work top and extends along the perimeter of the work top. The frame includes a plurality of uniformly spaced apertures. The apertures provide attachment points for mounting the various implements to the workbench. The implements may be mounted to the workbench anywhere around the perimeter of the workbench as dictated by the spacing of the apertures. The implements used in connection with the workbench such as vises, clamps and brackets include apertures or studs which correspond to the spacing of the apertures in the frame. The workbench implements may thereby be removably mounted to the workbench in a variety of positions without requiring any direct connection to the work surface of the bench top.

BRIEF DESCRIPTION OF THE DRAWINGS

FIG. 8 shows an alternate embodiment of the base having the legs bolted to the frame.

FIG. 9 is a cross sectional view taken along lines 9—9 of FIG. 8.

FIG. 10 shows a vise horizontally mounted to the workbench.

FIG. 11 shows a vise vertically mounted to the workbench.

FIG. 12 shows a front elevational view of the vise shown in FIGS. 10 and 11.

FIG. 21 is an elevational view of a dog from the vise.

FIG. 22 is an isometric view of a liner for the jaws of the vise.

DETAILED DESCRIPTION OF THE PREFERRED EMBODIMENTS

Figure 1:
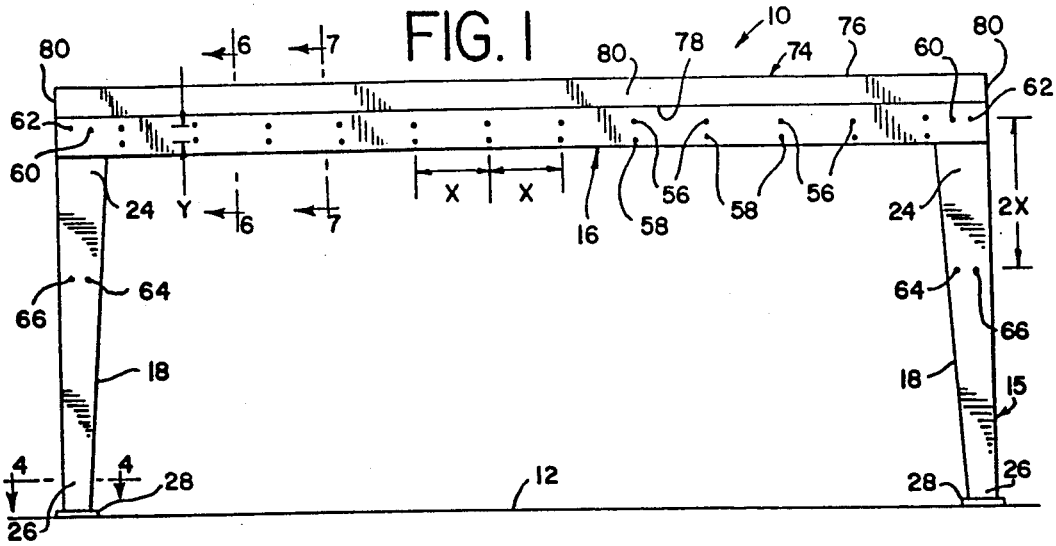
FIG. 1 is a side elevational view of the workbench.
Figure 4:
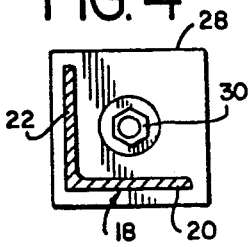
FIG. 4 is a cross sectional view taken along lines 4—4 of FIG. 1 showing the base bolted to the floor.
Figure 2:
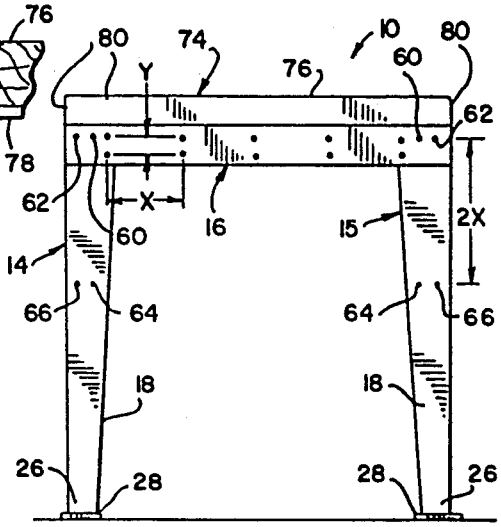
FIG. 2 is an end view of the workbench.
Figure 5:
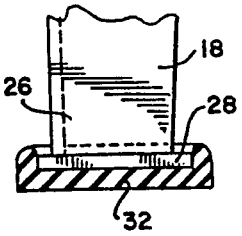
FIG. 5 is a cross sectional view taken along lines 4—4 of FIG. 1 showing the base resting upon an elastomeric pad.

The workbench 10 shown in FIG. 1 is resting upon a floor 12. The workbench 10 includes a base 14 having a frame 16 and a stand 15. The stand 15 includes four legs 18. Each leg 18 includes a first flange 20 and a second flange 22 which extend between a first end 24 and a second end 26. The legs 18 are preferably made from $\frac{1}{4}\times4\times4$ structural steel angles, however other sizes and different materials may be used as desired. A base plate 28 is attached to the second end 26 of each leg 18. As shown in FIG. 4, each base plate 28 may be fastened to the floor 12 by a fastener 30. As shown in FIG. 5, an elastomeric pad 32 may alternatively be placed between the base plate 28 and the floor 12 if it is not desired to bolt the base plate 28 to the floor 12. As shown in FIG. 1 and 2, the legs 18 are preferably tapered inwardly from the first end 24 to the second end 26.

Figure 6:
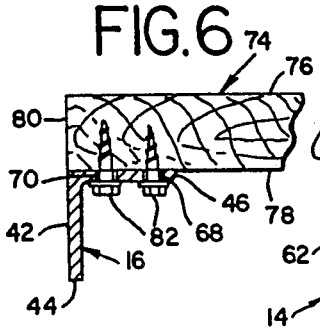
FIG. 6 is a partial cross sectional view taken along lines 6—6 of FIG. 1.
Figure 3:
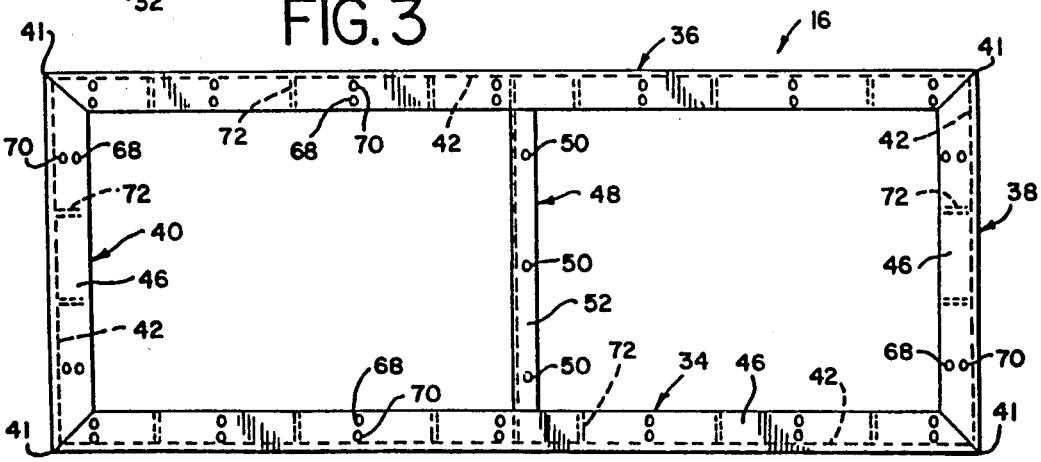
FIG. 3 is a top view of the workbench with the work top removed.

The frame 16 includes a front rail 34, a back rail 36, a right side rail 38 and a left side rail 40 which are connected end-to-end in the general shape of a rectangle having four corners 41 as shown in FIG. 3. Each rail 34–40, as shown in FIG. 6, includes a vertical leg 42 having a toe 44 and a horizontal leg 46. The rails 34–40 are preferably $\frac{3}{8}\times3\frac{1}{2}\times3\frac{1}{2}$ structural steel angles, however other sizes and different materials may be used as desired. A crossbar 48 is attached to the frame 16 between the back rail 36 and the front rail 34. The crossbar 48 laterally braces and stiffens the front rail 34 and the back rail 36. The crossbar 48 is preferably a $3/16\times2\times3$ structural steel angle, however other sizes and different materials may be used as desired. The crossbar 48 includes a plurality of apertures 50 in a horizontal leg 52. The horizontal leg 52 of the crossbar 48 is co-planar with the horizontal legs 46 of the frame 16.

The first ends 24 of the legs 18 are preferably welded to the toes 44 of the vertical legs 42 of the rails 34–40 at each corner 41 of the frame 16. However, as shown in FIG. 8 the legs 18 may be bolted to the frame 16 such that they are removable when desired. As shown in FIGS. 8 and 9, an angle 54 may be welded to the interior of the vertical leg 42 of the frame 16 at each corner 41 to enable each leg 18 to be removably fastened to the frame 16. The angle 54 extends a distance below the toe 44 such that the first and second flanges 20 and 22 of each leg 18 may be fastened to the angle 54. A shim 55 is located between each flange 20 and 22 and the angle 54 to provide clearance between the heel of angle 54 and the fillet of the leg 18.

As shown in FIGS. 1 and 2, each rail 34–40 of the frame 16 includes a plurality of upper apertures 56 which are equally spaced horizontally from one another by a distance X. Each rail 34–40 of the frame 16 also includes a plurality of lower apertures 58 which are also equally spaced horizontally from one another by a distance X. Each aperture 58 is additionally spaced vertically below a respective upper aperture 56 by a distance Y. The distance X is preferably $5\frac{3}{4}$ inches and the distance Y is preferably $1\frac{1}{2}$ inches although different distances may be used as desired. The end of each rail 34–40 additionally includes an aperture 60 and an aperture 62 which is spaced horizontally apart from the aperture 60 the distance Y. Each flange 20 and 22 of each leg 18 also includes an aperture 64, and an aperture 66 which is horizontally spaced from the aperture 64 by the distance Y. The aperture 64 in the leg 18 is vertically below the aperture 60 by a distance of two times X (2X) and the aperture 66 is located vertically below the aperture 62 by the distance 2X. Each upper aperture 56 and its vertically adjacent lower aperture 58 constitute a place of attachment on the frame 16. Each aperture 60 and its adjacent aperture 62 also constitute a point of attachment on the frame 16 as does each aperture 64 and its adjacent aperture 66. The toes 44 which extend along each rail 34–40 between the legs 18 constitute a substantially continuous attachable edge for the attachment of implements on the frame 16 as will be explained.

Figure 7:
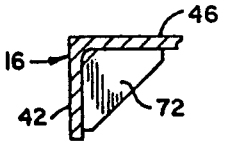
FIG. 7 is a partial cross sectional view taken along lines 7—7 of FIG. 1.

As shown in FIG. 3, the horizontal leg 46 of each rail 34–40 of the frame 16 includes a plurality of inner apertures 68 and a plurality of outer apertures 70 which are spaced apart from a respective inner aperture 68 by the distance Y. As shown in FIGS. 3 and 7, a plurality of gusset plates 72 are attached between the vertical leg 42 and the horizontal leg 46 of each rail 34–40 of the frame 16 to stiffen the rails 34–40. The gusset plates 72 are spaced so as not to interfere with any of the apertures in the frame 16.

The workbench 10 also includes a work top panel 74 as shown in FIGS. 1 and 2. The work top panel 74 includes an upper work surface 76, a lower attachment surface 78 and a peripheral edge 80 which extends around the perimeter of the top panel 74 between the work surface 76 and the attachment surface 78. The work top panel 74 is located adjacent to the horizontal legs 46 of the frame 16 such that the peripheral edge 80 of the work top 74 is flush with the vertical legs 42 of the frame 16 as shown in FIG. 6. The work top panel 74 is removably fastened to the frame 16 by screws 82 which extend through the apertures 68 and 70 of the horizontal leg 46 and into the attachment surface 80 of the top panel 74. The top panel is preferably 30 inches wide by 72 inches long, with the work surface 76 being approximately 33 inches above the floor 12. These dimensions may be varied as desired. The work top panel 74 is preferably made of $2\frac{1}{4}$ inch thick hard maple, however other dimensions and other materials may be used as desired. The work surface 76 and the peripheral edge 80 of the work top panel 74 should be smooth, flat and imperforate. The attachment surface 78 is the underside of the work top panel 74 and is not used as a work surface.

Various implements 88 may be removably mounted to the base 14 by attachment through any one of the apertures 56, 58, 60, 62, 64 or 66. The uniform spacing of the pairs of apertures 56 and 58 from adjacent pairs of apertures 56 and 58 by the distance X allows the implements 88 to be mounted to the base 14 at any desired location as dictated by the spacing distance X. Various implements 88 may also be removably mounted to the base 14 by attachment to any point along the toe 44 of the frame 16. The mounting of the implements 88 to the workbench 10 is made to the base 14 of the workbench 10 independently from the top panel 74. The mounting of the implements 88 to the base 14 does not require that the top panel 74 or its work surface 76 be cut, drilled or otherwise perforated or impaired. Each implement 88 may be mounted to the base 14 in a variety of different locations as desired for use with the workbench 10 without harming or directly attaching to the work top panel 74. More than one implement 88, or a variety of different types of implements 88, may be mounted to the base 14 at one time for use with the workbench 10, all independently of the work top panel 74.

One type of implement 88A which may be mounted to the base 14 of the workbench 10 is a vise 90 as shown in FIGS. 10 through 22. The vise 90 includes a movable jaw 92 and a fixed jaw 94. The movable jaw 92 includes a plate 96 and a top plate 98 attached thereto and extending perpendicular from the top edge of the plate 96. A side plate 100 is attached to and extends perpendicularly from each side of the plate 96. The plate 96 includes four apertures 102 and an aperture 104. The top plate 98 includes two apertures 106 and two apertures 108. A sleeve 110 is attached to the plate 96 such that the sleeve 110 is concentric with the aperture 104. A rod 114 having a cylindrical portion 116 attached to a threaded portion 118 by a spherical portion 120 extends through the aperture 104 such that the spherical portion 120 is located within the sleeve 110. A spherical bushing 122 is located within the sleeve 110 adjacent to the spherical portion 120 to provide an antifriction connection between the rod 114 and the moveable jaw 92. The spherical bushing 122 is preferably an aluminum bronze bushing. The rod 114 preferably has a one inch diameter threaded portion 118 and a $1\frac{7}{8}$ inch diameter spherical portion 120. A cover plate 124 having an aperture 126 is located adjacent to the sleeve 110 and is fastened thereto by bolts 128 such that the cylindrical portion 116 extends through the aperture 126. A handle 130 is slidably attached to the cylindrical portion 116 of the rod 114.

Figure 15:
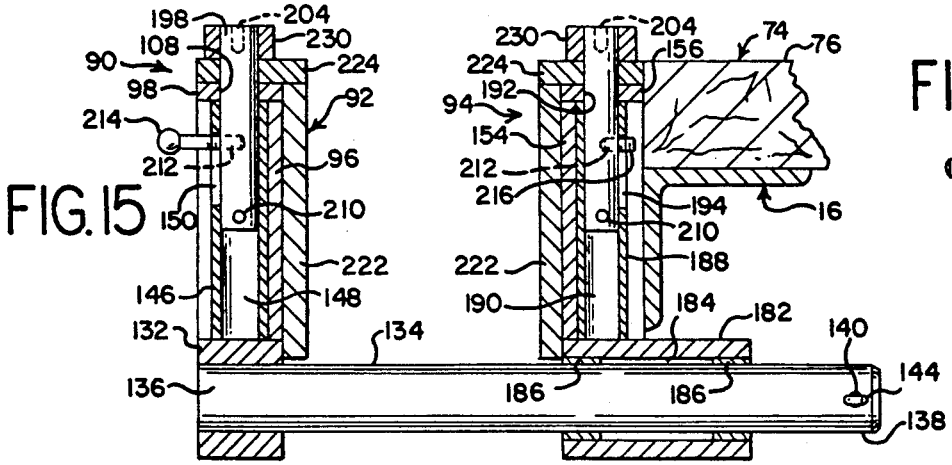
FIG. 15 is a cross sectional view taken along lines 15—15 of FIG. 13.

The moveable jaw 92 also includes two sleeves 132, as shown in FIGS. 12 and 15, which are connected to the plate 96 and to the sleeve 110 at opposite sides thereof. A guide tube 134 having a first end 136 and a second end 138 extends through each sleeve 132 with the first end 136 affixed within the sleeve 132. The second end 138 of each guide tube 134 includes a pair of apertures 140 through which a cotter pin 144 may be placed. A preferred guide tube 134 is approximately $1\frac{1}{2}$ inches in outer diameter. A tube 146 extends between each sleeve 132 and the top plate 98. Each tube 146 includes a hollow chamber 148 and a vertical slot 150. The tubes 146 are located such that the chambers 148 align with respective apertures 108 in the top plate 98. Each tube 146 also includes two diametrically opposed apertures 152.

Figure 13:
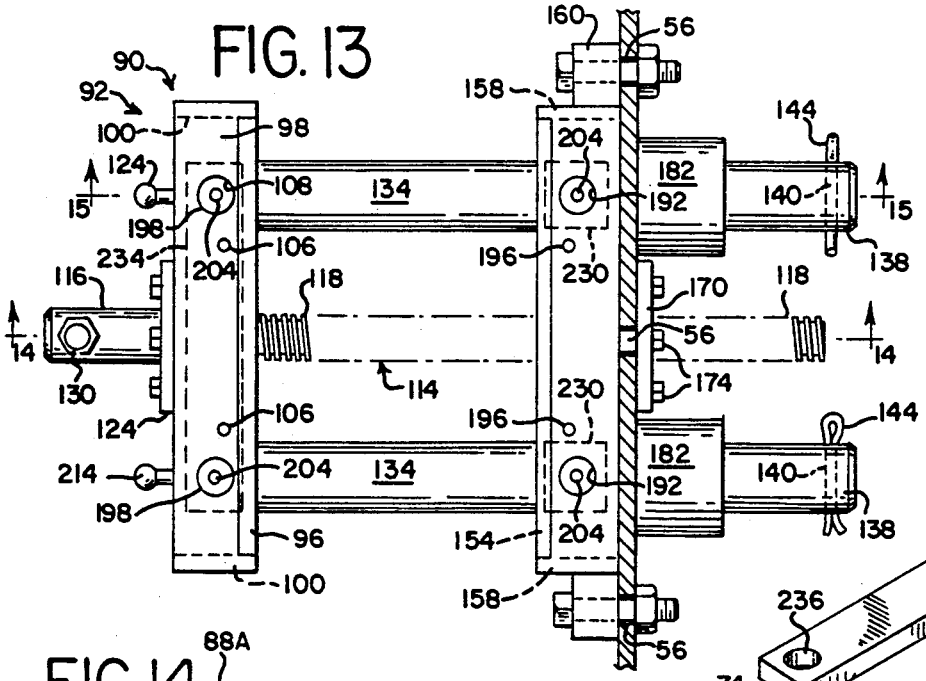
FIG. 13 shows a top plan view of the vise.
Figure 14:
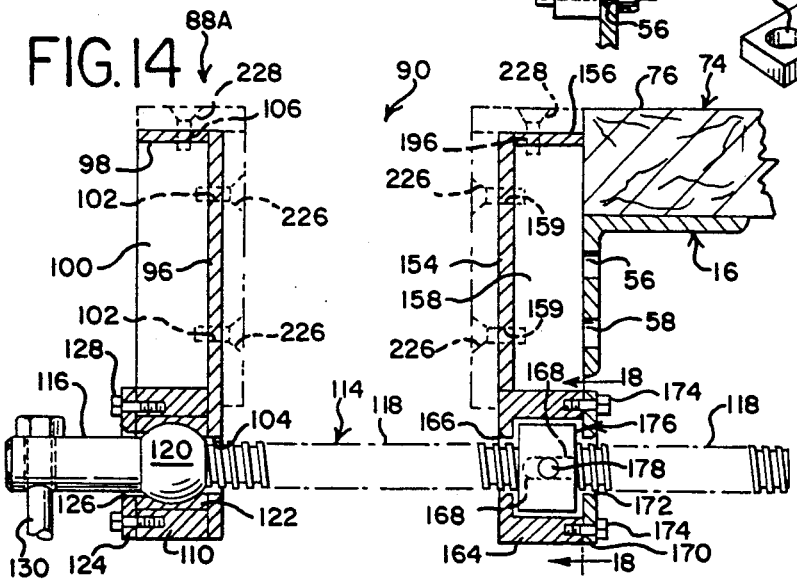
FIG. 14 is a cross sectional view taken along lines 14—14 of FIG. 13.
Figure 18:
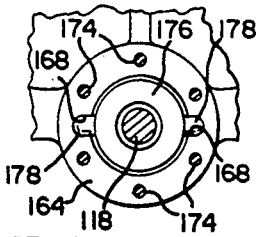
FIG. 18 is an elevational view of the trunnion nut housing of the vise taken along lines 18—18 of FIG. 14.
Figure 19:
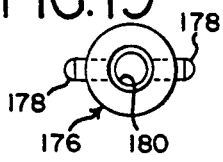
FIG. 19 shows the trunnion nut of the vise.

The fixed jaw 94, as shown in FIGS. 13–15, includes a plate 154 having a top plate 156 attached to and extending perpendicularly from the top edge of the top plate 156 and a side plate 158 attached at each side of the plate 154 and extending perpendicularly thereto. The plate 154 includes four apertures 159 which are aligned with the apertures 102 in plate 96. An ear 160 is attached to each side plate 158. Each ear 160 includes two apertures 162 which are spaced apart from one another by the distance Y to correspond to the distance Y which the apertures 56 and 58, 60 and 62, and 64 and 66 are spaced apart from one another thereby allowing the apertures 162 to align with the apertures in the base 14. The apertures 162 in one ear 160 are spaced apart from the apertures 162 in the other ear 160 by a distance of 2X to correspond to the distance between the apertures 60 and 64, and 62 and 66 in the base 14 to allow the vise 90 to be vertically mounted at any corner 41 as shown in FIG. 11 and to correspond to any pair of apertures 56 and 58 which are spaced apart the distance 2X to allow the vise 90 to be horizontally mounted to the frame 16 as shown in FIG. 10 in a plurality of locations. A housing 164 is attached to the bottom center portion of the plate 154. The housing 164 includes an aperture 166 and two diametrically opposed slots 168. A cover plate 170, having an aperture 172, is removably fastened to the housing 164 by bolts 174. A trunnion nut 176 having two extending trunnions 178 and a threaded aperture 180, as shown in FIGS. 14 and 19, is located within the housing 164 with the trunnions 178 extending into respective slots 168 such that the trunnion nut 176 is able to pivot about the trunnions 178. The threaded aperture 180 of the trunnion nut 176 is adapted to threadably engage the threaded portion 118 of the rod 114. The nut 176 is preferably an aluminum bronze nut. The fixed jaw 94 also includes two sleeves 182 which are attached to the plate 154 at either side of the housing 164 and in alignment with the sleeves 132 of the movable jaw 92. Each sleeve 182 includes a circular bore 184. A bushing 186 is located at each end of each sleeve 182 within the circular bore 184. The bushings 186 are adapted to permit a guide tube 134 to slide within each sleeve 182. The bushings 186 are preferably aluminum bronze bushings. The fixed jaw 94 also includes two tubes 188 which extend between a respective sleeve 182 and the top plate 156. Each tube 188 includes a chamber 190 which is aligned with an aperture 192 in the top plate 156 as shown in FIG. 15. Each tube 188 also includes a slot 194 and a pair of diametrically opposed apertures not shown. The top plate 156 also includes a pair of apertures 196.

The appropriate rotation of the handle 130 and the rod 114 will draw the rod 114 through the trunnion nut 176 thereby pulling the movable jaw 92 towards the fixed jaw 94. A workpiece may be positioned between the jaws 92 and 94 such that as the moveable jaw 92 is pulled towards the fixed jaw 94, the workpiece will become clamped between the jaws 92 and 94. Further rotation of the rod 114 will apply additional clamping force to the workpiece. Opposite rotation of the rod 114 will move the moveable jaw 92 away from the fixed jaw 94 thereby decreasing the clamping force on the workpiece.

Figure 20:
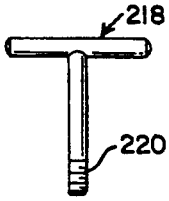
FIG. 20 shows a tool for raising or lowering the dogs of the vise.

A dog 198, as shown in FIG. 21, includes an upper end 200 and a lower end 202 and is preferably cylindrical in shape. The dog 198 includes a threaded aperture 204 extending downwardly from the upper end 200 along the longitudinal axis of the dog 198. A bore 206 extends through the lower end 202 of the dog 198 perpendicular to the longitudinal axis of the dog 198. A spring 208 is located within the bore 206 and a spherical ball 210 is located at each end of the spring 208 such that the spring 208 biases the spherical balls 210 outwardly from the dog 198. The dog 198 also includes a threaded aperture 212 which extends into the dog 198 in a direction perpendicular to the longitudinal axis of the dog 198. A dog 198 is located within each of the tubes 146 and 188. The dogs 198 which are located within the tubes 146 have a stem 214 attached to the threaded aperture 212 and extending horizontally through the slot 150 as best shown in FIG. 15. The dogs 198 which are located within the tubes 146 may be raised or lowered by grasping the stem 214 and moving the stem 214 upwardly or downwardly within the slot 150. When the dogs 198 within the tubes 146 are in their lowered positions, the upper end 200 of the dogs 198 will be flush with the top plate 98. When the dogs 198 within the tubes 146 are moved to their raised positions, the dogs 198 will extend through the apertures 108 in the top plate 98 and the spring 208 will bias the spherical balls 210 into the apertures 152 of the tubes 146 to releasably hold the dogs 198 in the raised position. Two dogs 198 are also respectively located within the tubes 188 of the fixed jaw 94 as shown in FIG. 15. A screw 216 is threadably fastened to the threaded aperture 212 and extends outwardly through the slot 194 of the tube 188 to prevent rotation of the dogs 198 within the tubes 188. The dogs 198 in the fixed jaw 94 may be moved to their raised position by threadably inserting a tool 218, having a threaded portion 220 as shown in FIG. 20, into the threaded aperture 204 of the dogs 198 and pulling the dogs 198 upward. Once the dogs 198 in the fixed jaw 94 have been raised, the tool 218 may be removed and the spring 208 will bias the spherical balls 210 into the apertures 196 of the tubes 188 to releasably hold the dogs 198 in the raised position. The dogs 198 in the fixed jaw 94 may be moved to their lowered position by applying a downward force on the dogs 198. When the dogs 198 are in their lowered positions, the dogs 198 are inoperative and located out of the way. When the dogs 198 are raised, a workpiece may be clamped between the dogs 198 located in the respective jaws 92 and 94. The dogs 198 may also serve as stops to secure a workpiece in position.

A liner 221 having a vertical plate 222 and a horizontal plate 224 as shown in FIG. 22 may be attached to both the movable jaw 92 and to the fixed jaw 94. The liners 221 provide a softer clamping surface than the plates 96 and 154 to protect a workpiece which is clamped within the vise 90 from being damaged. The vertical plate 222 includes four countersunk apertures 226 which are adapted to be fastened through the apertures 102 to the movable jaw 92 and through the aperture 159 to the fixed jaw 94. The horizontal plate 224 includes two countersunk apertures 228 which are adapted to be fastened through the apertures 106 to the movable jaw 92 and through the apertures 196 to the fixed jaw 94 as shown in FIG. 14. The plates 222 and 224 are preferably made of wood.

Figure 16:
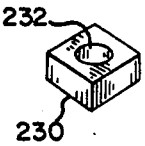
FIG. 16 shows a bearing block for use in connection with the vise.
Figure 17:
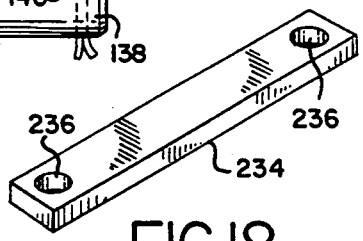
FIG. 17 shows a bearing bar for use in connection with the vise.

A block 230, as shown in FIG. 16, is substantially square and includes an aperture 232. A bar 234, as shown in FIG. 17, includes two apertures 236 and is substantially rectangular in shape. When a dog 198 is in its raised position, a block 230 may be placed on the vise 90 such that the dog 198 extends through the aperture 232 as shown in the fixed jaw 94 in FIGS. 13 and 15. The bar 234 may alternatively be placed on the vise 90 such that a pair of dogs 198 respectively extend through the apertures 236 as shown on the movable jaw 92 in FIGS. 13 and 15. The blocks 230 and the bar 234 are preferably made of wood. The blocks 230 and bars 234 are generally rectangular and therefore provide a larger bearing surface than provided just by the dogs 198. This helps to reduce the possibility that the clamping forces exerted by the dogs on the workpiece will indent or otherwise harm the workpiece.

The vise 90 may be mounted in a horizontal position, as shown in FIG. 10, to the frame 16 of the workbench 10 by fasteners 237 extending through apertures 56 and 58 or the vise 90 may be attached in a vertical position, as shown in FIG. 11, to the frame 16 and to a leg 18 of the workbench 10 by fasteners 237 extending through apertures 60–66. The vise 90 may be mounted vertically to any of the flanges 20 and 22 of the legs 18. When the vise 90 is mounted horizontally to the base 14, the top plates 98 and 156 are below the work surface 76 as shown in FIG. 10. The vise 90 may be mounted to the frame 16 at any pair of apertures 56 and 58 which are spaced apart by a distance 2X. The vise 90 may thereby be mounted to the base 14 in a variety of different locations for use with the workbench 10 without harming or directly attaching to the work surface 76.

The guide rods 134 of the vise 90 will support the downward loads applied to the vise and in doing so may deflect or bend downwardly. The rod 114 however is supported at one end by the pivotable trunnion nut 176 which will allow the rod 114 to pivot downwardly without causing any bending in the rod 114. The rod 114 will therefore be subject to only tensile or compressive forces and not bending forces. As a result, there will be less friction between the nut 176 and the rod 114 and less torque will need to be applied to the rod 114 to reach the desired clamping force between the jaws 92 and 94.

Figure 23:
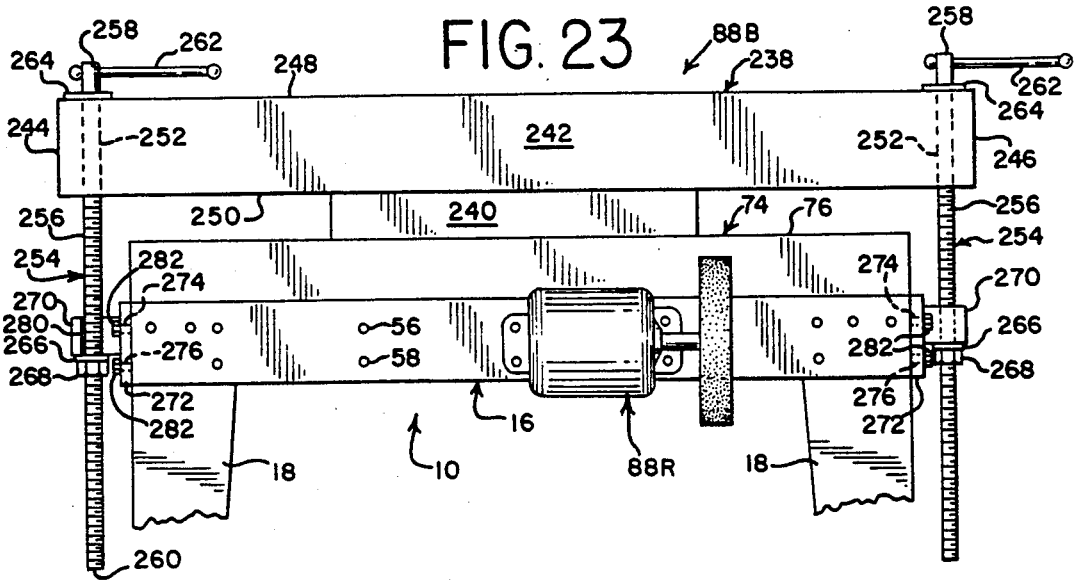
FIG. 23 is an end view of the workbench having a beam clamp mounted thereto.

Another implement 88B is a beam clamp 238. The beam clamp 238 is shown in FIG. 23 attached to opposite sides of the frame 16 of the workbench 10. The beam clamp 238 is shown clamping a workpiece 240 against the work surface 76 of the work top panel 74. The beam clamp 238 includes a beam 242 having a first end 244, a second end 246, a top surface 248 and a bottom surface 250. A bore 252 extends through the beam 242, from the top surface 248 to the bottom surface 250, at the first end 244 and at the second end 246. The beam clamp 238 also includes a pair of clamping screws 254 which respectively include a threaded rod 256 extending between a first end 258 and a second end 260. A handle 262 is slidably attached to the first end 258 and a washer 264 is attached to the threaded rod 256 by welding or other means a short distance below the handle 262. A threaded rod 256 extends through each respective bore 252 such that the washer 264 will abut the top surface 248 of the beam 242. The threaded rod 256 extends through a washer 266 and a nut 268 is threadably attached to the threaded rod 256 to retain the washer 266. An anchor bracket 270, best shown in FIG. 24, includes a plate 272 having two upper apertures 274 spaced apart by a distance X and two lower apertures 276 spaced apart by a distance X. The upper apertures 274 are located above respective apertures 276 a distance Y. A mounting plate 278 having a slot 280 is attached to the plate 272.

Figure 24:
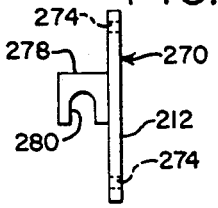
FIG. 24 is a top plan view of an anchor bracket.

An anchor bracket 270 is attached to opposite sides of the frame 16 as shown in FIG. 24. Each anchor bracket 270 is attached to the frame 216 by fasteners 282 which extend through the apertures 274 and 276 of the anchor bracket 270 and the apertures 56 and 58 of the frame 16. The threaded rod 256 of each clamping screw 254 is located in a respective slot 280 of the anchor bracket 270. The nut 268 is run up the threaded rod 256 such that the washer 266 engages the mounting bracket 278. A clamping force against the workpiece 240 may be applied or released by appropriate rotation of the threaded rods 256. The beam 242 may be made of wood, metal or other materials. One or more beam clamps 238 may be used in connection with the workbench 10 and the beam clamp 238 may extend from the back rail 36 to the front rail 34 or from the left side rail 40 to the right side rail 38. The beam clamp 238 is easily and quickly mountable to the frame 16 at any pair of apertures 56 and 58. The beam clamp 238 may thereby be mounted to the base 14 in a variety of different locations as desired for use with the workbench 10 without harming or directly attaching to the work surface 76.

Figure 25:
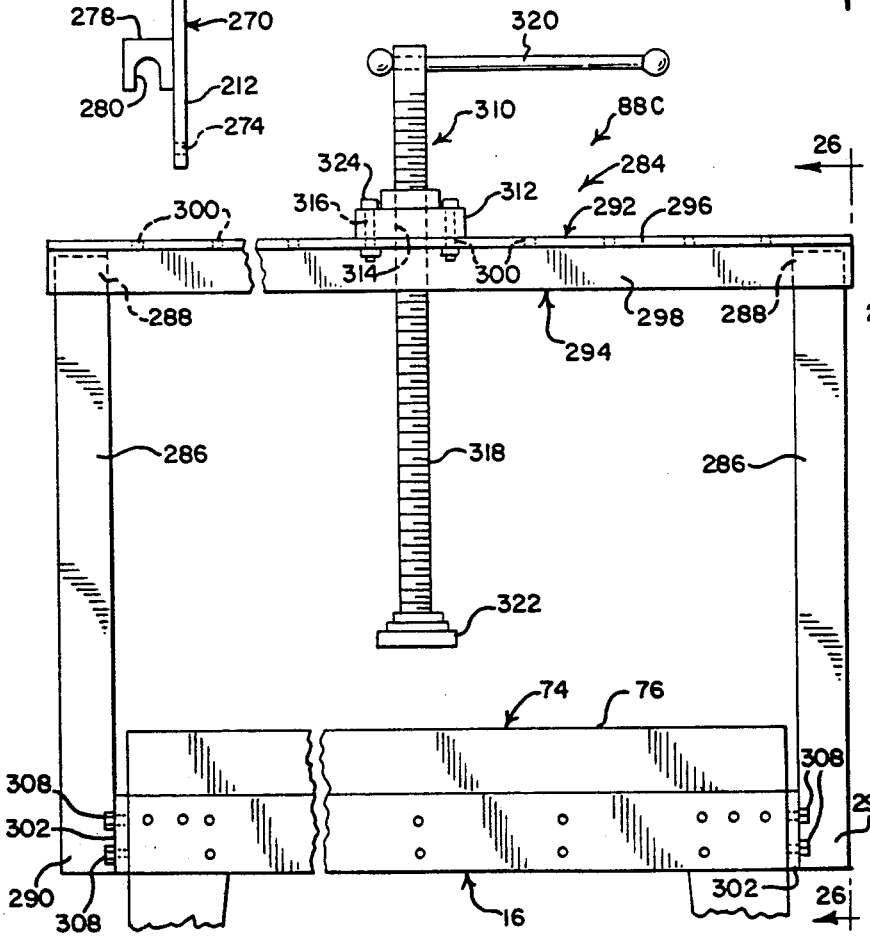
FIG. 25 is an end view of the workbench having a press clamp mounted thereto.
Figure 26:
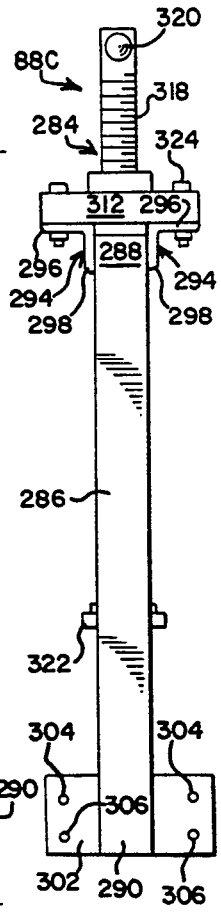
FIG. 26 is a side elevational view of the press clamp taken along lines 26—26 of FIG. 25.

Another implement 88C is a press clamp 284 as shown in FIGS. 25 and 26. The press clamp 284 includes two posts 286 each having an upper end 288 and a lower end 290. The posts 286 are spaced apart from one another and are connected to one another at their upper ends 288 by a cross beam 292. The cross beam 292 includes two spaced apart angles 294 each having a horizontal leg 296 and a vertical leg 298. The horizontal leg 296 of each angle 294 includes a plurality of apertures 300 which are equally spaced along the angles 294. A mounting plate 302 is attached to the lower end 290 of each post 296. The mounting plate 302 includes two upper apertures 304 which are spaced apart a distance X and two lower apertures 306 which are spaced apart a distance X. The lower apertures 306 are located below respective upper apertures 304 by a distance Y. A mounting plate 302 is attached to opposite sides of the frame 16 by fasteners 308 as shown in FIG. 25. The press clamp 284 also includes a press 310 which includes a mounting block 312 having a threaded aperture 314 and four bores 316 extending through the mounting block 312 which are spaced to align with the apertures 300 in the angles 294. The press 310 also includes a threaded rod 318 which extends through the threaded aperture 314 of the mounting block 312. The threaded rod 318 includes a handle 320 slidably attached to one end and a foot 322 pivotally attached to the other end of the threaded rod 318. The mounting block 312 is attached to the cross beam 292 by fasteners 324. The press clamp may be attached to the frame 16 at any pair of adjacent apertures 56 and 58. The press 310 may be attached to the cross beam 92 at different locations between the posts 286 as desired and dictated by the spacing of the apertures 300. One or more presses 310 may be used in connection with each press clamp 284 and one or more press clamps 284 may be used at one time with the workbench 10 such as when needed for applying veneer and in other gluing operations.

Figures 27, 28, 29, 30, 31, 32, 33:
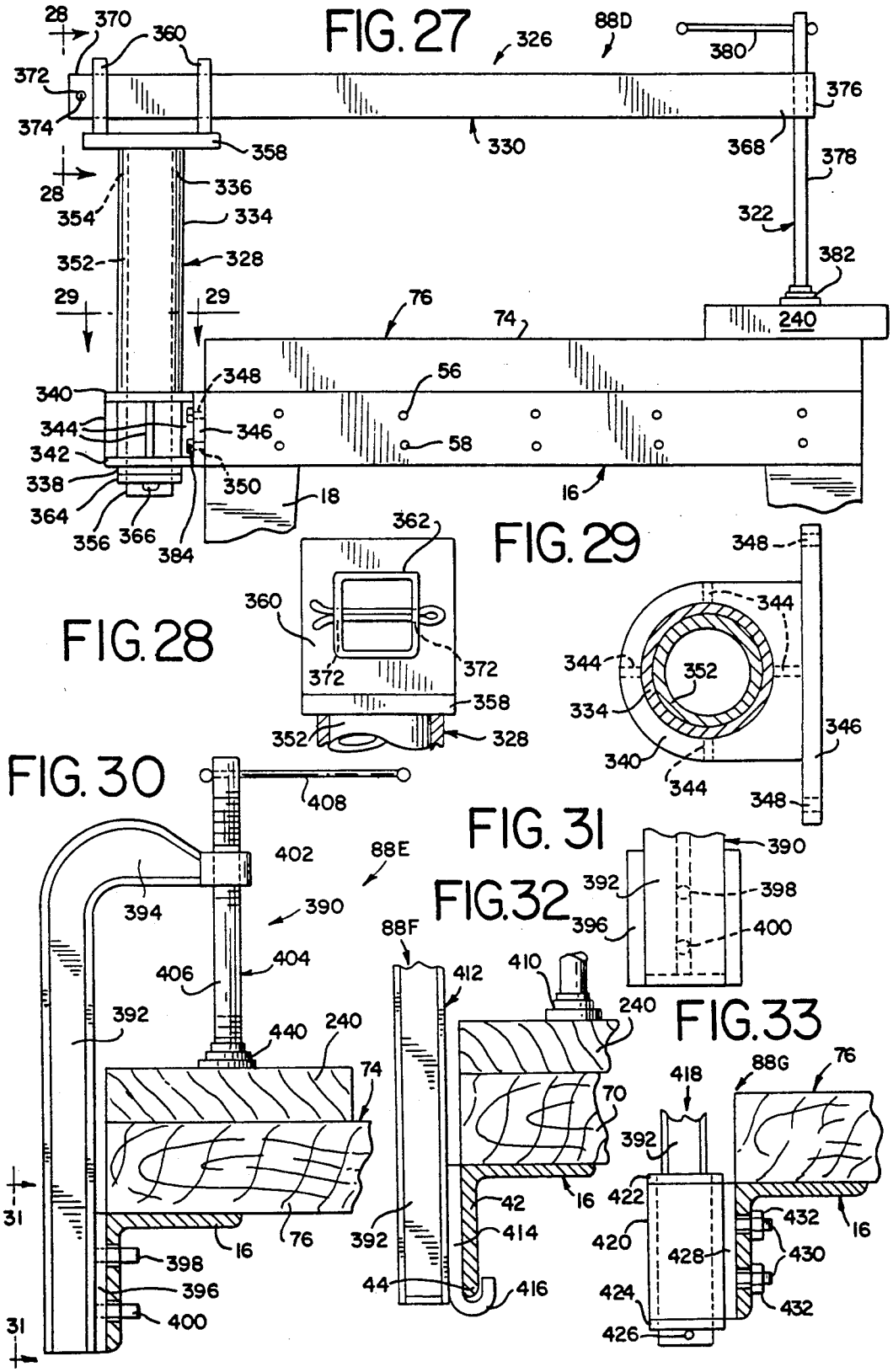
FIG. 27 is an end view of the workbench having a radial arm clamp mounted thereto.
FIG. 28 is a partial end view of the radial arm clamp taken along lines 28—28 of FIG. 27.
FIG. 29 is a cross sectional view taken along lines 29—29 of FIG. 27.
FIG. 30 shows a C-type clamp mounted to the workbench.
FIG. 31 is a partial elevational view taken along lines 31—31 of FIG. 30.
FIG. 32 shows an alternate embodiment of a C-type clamp having a hooked end mounted to the workbench.
FIG. 33 shows an alternate embodiment of a C-type clamp having a rotatable mounting which is mounted to the workbench.

Another implement 88D is a radial arm clamp 326 as shown in FIGS. 27–29. The radial arm clamp 326 includes a post 328, an arm 330 and a press 332. The post 328 includes an outer tube 334 having a first end 336 and a second end 338. The outer tube 334 has its second end 338 extend through and affixed to an upper plate 340 and a lower plate 342. The lower plate 342 is spaced apart from the upper plate 340 by four web members 344. A mounting plate 346 is attached to the upper plate 340, the lower plate 342 and one of the web members 344. The mounting plate 346 includes two upper apertures 348 which are spaced apart by a distance X and two lower apertures 350 which are also spaced apart a distance X. The lower apertures 350 are located directly below respective upper apertures 348 by a distance Y. An inner tube 352 having a first end 354 and a second end 356 extends through the outer tube 334. A plate 358 is attached to the first end 354 of the inner tube 352 and is located adjacent the first end 336 of the outer tube 334. Two brackets 360 are attached to the plate 358. Each bracket 360 includes a square aperture 362. The second end 356 of the inner tube 352 extends below the second end 338 of the outer tube 334. A washer 364 is placed around the second end 356 of the inner tube 352 and adjacent the second end 338 of the outer tube 342 and is held in position with a cotter pin 366.

The arm 330 has a first end 368 and a second end 370. The second end 370 of the arm 330 extends through the square apertures 362 of the brackets 360. The second end 370 of the arm 330 includes an aperture 372 through which a cotter pin 374 is inserted. A threaded sleeve 376 is attached to the first end 368 of the arm 330. The arm 330 is preferably rectangular and is preferably made of metal tubing although other materials may be used as desired. The press 332 includes a threaded rod 378 which is threadably engaged to the threaded sleeve 376. The threaded rod 378 has a handle 380 slidingly attached at one end and a foot 382 pivotally attached at the other end. The arm 330 may be radially extended or retracted through the brackets 360 such that the press 332 may be placed varying distances from the post 328 as desired. The post 328 allows the inner tube 352 to rotate within the outer tube 334 to thereby allow the arm 330 and the press 332 to rotate about the longitudinal axis of the inner tube 352. The radial arm clamp 326 is attached to the frame 16 in any one of a plurality of positions by fasteners 384 which extend through the apertures 348 and 350 of the mounting plate 346 and any of the apertures 56 and 58 of the frame 16. One or more radial arm clamps 326 may be attached to the frame at any one time. The arm 330 can be of sufficient length such that the press 332 can reach any location on the work surface 76 of the work top panel 74 for the purpose of clamping a workpiece against the work surface 76.

Another implement 88E is a C-type clamp 390 shown in FIGS. 30 and 31. The C-type clamp 390 includes a shank 392 and an arm 394. A mounting plate 396 is attached to the lower end of the shank 392. The mounting plate 396 includes an upper stud 398 and a lower stud 400 which is located directly below the upper stud 398 by a distance Y. A threaded sleeve 402 is attached to the end of the arm 394. A press 404 includes a threaded rod 406 which threadably engages the threaded sleeve 402. The threaded rod 406 has a handle 408 slidingly attached at one end and a foot 410 pivotally attached at the other end. The studs 398 and 400 are inserted into any respective apertures 56 and 58 in the frame 16 to hold the clamp 390 in position while a clamping force is applied to the workpiece 240 by the press 404. The studs 398 and 400 could alternatively be threaded to receive nuts (not shown) to removably fasten the clamp 390 to the frame 16.

An alternate embodiment of the C-type clamp 390 is shown in FIG. 32 as implement 88F, which is a clamp 412. The clamp 412 includes a shank 392, an arm 394 and a press 404. A plate 414 having a hooked end 416 in the general shape of a "J" is attached to the lower end of the shank 392. The hooked end 416 is located around the toe 44 of the vertical leg 42 of the frame 16 to hold the clamp 412 in position while a clamping force is exerted upon the workpiece 240 by the press 404. The clamp 412 may slide along the toe 44 of the frame 16 to any position between the legs 18 which offers limitless arrangements of one or more clamps 412 for clamping a workpiece against the work surface 76.

Another alternate embodiment of the C-type clamp 390 is shown in FIG. 33 as implement 88G, which is a clamp 418. The clamp 418 includes a shank 392, an arm 394 and a press 404. The shank 392 extends through a sleeve 420. A plate 422 is attached to the shank 392 and is located adjacent to the top of the sleeve 420. A washer 424 is removably placed around the shank 392 and is located adjacent the bottom end of the sleeve 420 and is held in place by a cotter pin 426. A mounting plate 428 is attached to the sleeve 420. The mounting plate 428 includes a pair of threaded studs 430 which are located vertically above one another a distance Y. The studs 430 are inserted through any respective apertures 56 and 58 in the frame 16. The clamp 418 is fastened in place with nuts 432. The shank 392 is free to rotate about its longitudinal axis within the sleeve 420.

Figures 34, 35, 36, 37, 38, 39, 40, 41, 42, 43, 44, 45:
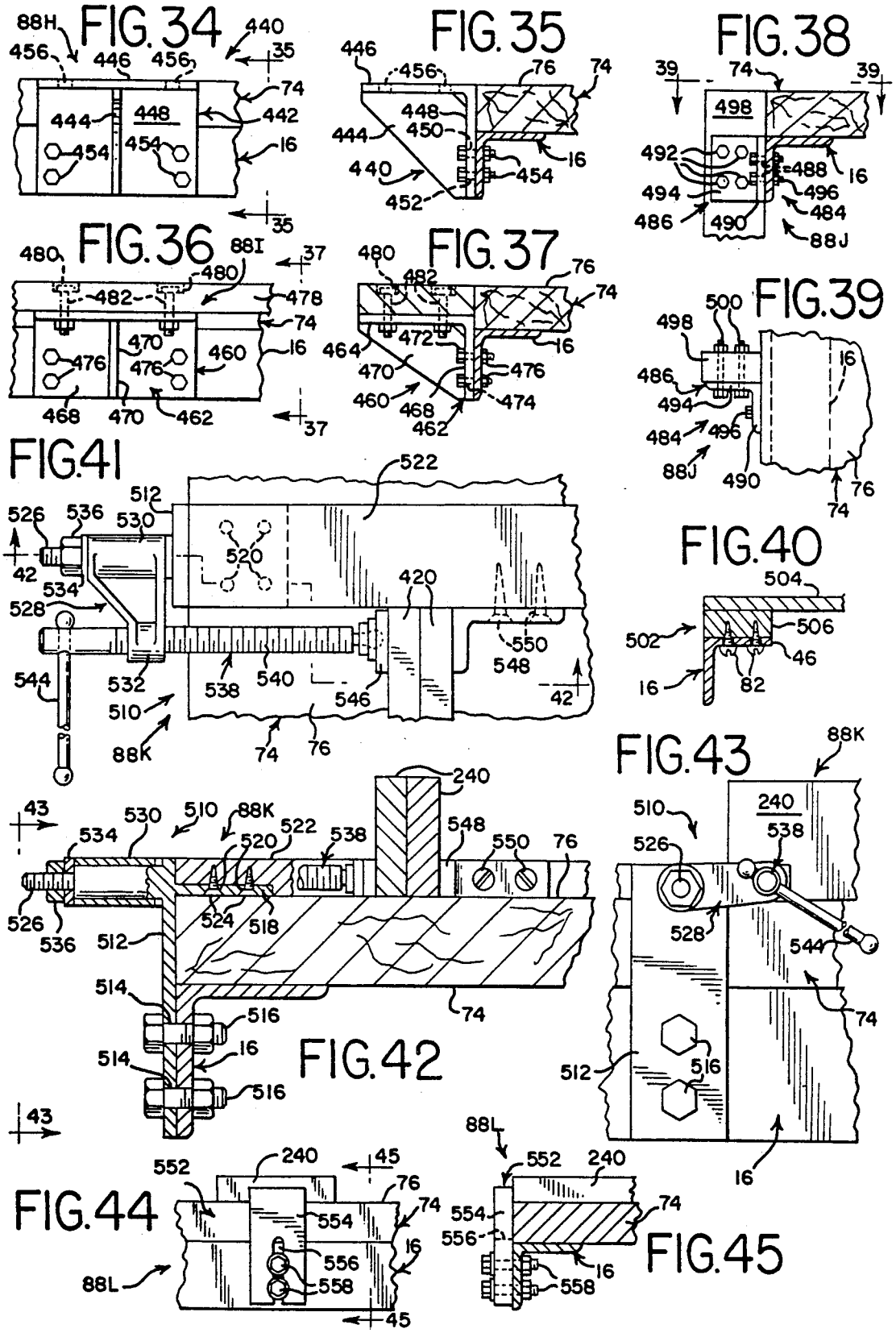
FIG. 34 shows a bracket mounted to the workbench.
FIG. 35 is a partial cross sectional view taken along lines 35—35 of FIG. 34.
FIG. 36 is a front elevational view of a bracket and a horizontal board mounted to the workbench.
FIG. 37 is a partial cross sectional view taken along lines 37—37 of FIG. 36.
FIG. 38 shows a bracket and a vertical board mounted to the workbench.
FIG. 39 is a top plan view taken along lines 39—39 of FIG. 38.
FIG. 40 shows an alternate work top panel.
FIG. 41 is a top plan view of a surface clamp mounted to the workbench.
FIG. 42 is a cross sectional view taken along lines 42—42 of FIG. 41.
FIG. 43 is a front elevational view taken along lines 43—43 of FIG. 42.
FIG. 44 is an elevational view of a stop.
FIG. 45 is a cross sectional view taken along lines 45—45 of FIG. 44.

Another implement 88H shown in FIGS. 34 and 35 is a flush mounted bracket 440 which includes an angle 442 and a stiffener 444. The angle 442 has a horizontal leg 446 and a vertical leg 448. The vertical leg 448 includes two upper apertures 450 spaced apart by distance X and two lower apertures 452 spaced apart by distance X. The lower apertures 452 are located beneath respective upper apertures 450 by a distance Y. The bracket 442 is attached to the frame 16 by fasteners 454 which extend through the apertures 452 and 454 of the bracket 442 and any adjacent pair of apertures 56 and 58 in the frame 16. The horizontal leg 446 may include various apertures 456 for the purpose of mounting various items such as an anvil, work stand or drill press to the bracket 440. A piece of wood may also be attached to the bracket 442 to serve as a stop.

Another implement 88I shown in FIGS. 36 and 37 is a bracket 460 which includes an angle 462 having a horizontal leg 464 and a vertical leg 468. A stiffener 470 extends between the horizontal leg 464 and the vertical leg 468. The vertical leg 468 includes two upper apertures 472 spaced apart a distance X and two lower apertures 474 spaced apart a distance X. The lower apertures 474 are located below the upper apertures 472 by a distance Y. The bracket 460 is attached to the frame 16 by fasteners 476 which extend through the apertures 472 and 474 of the bracket 460 and any adjacent pair of apertures 56 and 58 of the frame 16. The horizontal leg 464 is located a distance below the surface 76 of the work top panel 74. A board 478 is attached to the horizontal leg 464 by fasteners 480 which extend through apertures 482. The top surface of the board 478 is flush with the work surface 76. The board 478 may be attached to a plurality of brackets 460 which are spaced along the frame 16 such that the board 478 extends the entire length of one side of the workbench 10. Workpieces 240 may be attached to the board 478 and thereby to the workbench 10 by nailing or other fastening means without damaging the work surface 76. The board 478 may also be used as a chopping block, a back up plate for drilling holes and other purposes as the board 478 is expendable and replaceable.

Another implement 88J shown in FIGS. 38 and 39 is a bracket 484 which includes an angle 486. The angle 486 includes two apertures 488 which are spaced apart by a distance Y in a first leg 490 and four apertures 492 which are located in a second leg 494. The legs 490 and 494 are positioned vertically such that the angle 486 may be attached to the frame 16 by fasteners 496 which extend through the apertures 488 of the angle 486 and respectively through any apertures 56 and 58 in the frame 16. A board 498 may be attached to the second leg 494 by fasteners 500 which extend through the apertures 492. The board 498 extends vertically above or below the work surface 76 any distance as desired. The board 498 may be drilled or other pieces of wood or metal may be attached to the board 498 to make jigs or fixtures.

FIG. 40 shows a replacement panel 502 which may replace the work top panel 74. The replacement panel 502 includes a sheet 504 and a piece of wood stock 506 or the like attached to the lower surface and around the perimeter of the sheet 504. The wood stock 506 is located adjacent the horizontal leg 46 of the frame 16 and is attached thereto with screws 82. The sheet 504 is preferably $\frac{3}{4}$ inch plywood and the wood stock 506 is preferably 2×4 pieces of lumber. The replacement panel 502 may be used to replace the work top panel 74 when it is necessary to have workpieces 240 or other items fastened directly to the replacement panel 502. The screws 82 are removed from the panel 74 and the panel 74 is then removed from the base 14. The replacement panel 502 may then be placed on the base 14 and secured thereto with the screws 82. The replacement panel 502 thereby provides an expendable working surface which may be replaced when damaged while preserving the top panel 76.

Another implement 88K shown in FIGS. 41 through 43 is a surface clamp 510. The clamp 510 includes a vertically extending plate 512 which includes two apertures 514 which are spaced vertically apart from one another a distance Y. The plate 512 is fastened to the frame 16 by fasteners 516 which extend through the apertures 514 and any aperture 56 and 58 in the frame 16. A plate 518 extends perpendicularly from the plate 512 adjacent to the work surface 76 of the work top panel 74. The plate 518 includes four apertures 520. An arm 522 extends outwardly from the plate 512 and is attached to the plate 518 by screws 524. A threaded stud 526 extends from the plate 512 on the opposite side of the plate 518. A coupling 528 including a cylindrical sleeve 530 and a threaded sleeve 532, has the cylindrical sleeve 530 placed over the threaded stud 526. The coupling 528 is held in place by a washer 534 and nut 536 such that the coupling 528 may rotate about the central axis of the cylindrical sleeve 530. A press 538 includes a threaded rod 540 which extends through the threaded sleeve 532. The threaded rod 540 includes a handle 544 slidably attached at one end and a foot 546 pivotally attached at the other end. The coupling 528 allows the press 538 to rotate to either side of the arm 522. An L-shaped bracket 548 is removably attached to the arm 522 by fasteners 550. The bracket 548 may be located along the arm 522 as desired and on either side of the arm 522 as desired depending upon which side of the arm the press 538 is to be used. A clamping force will be exerted upon a workpiece 240 between the foot 546 of the press 548 and the L-shaped bracket 548. The surface clamp 510 may be mounted as desired to the workbench 10 at any apertures 56 and 58. One or more surface clamps 510 may be used with the workbench 10 at any one time.

Another implement 88L shown in FIGS. 44 and 45 is a stop 552 which includes a plate 554 having a slot 556. The stop 552 is attached to the frame 16 by fasteners 558 which extend through the slot 556 and through any respective apertures 56 and 58 of the frame 16. The slot 556 allows the top of the stop 52 to be placed various distances above the work surface 76 as desired. The stop 552 may be attached to the frame at any pair of apertures 56 and 58 as desired for the purpose of stationarily positioning a workpiece on the work surface 76 without damaging the work surface 76 or requiring any attachment to the panel 74.

Figure 46:
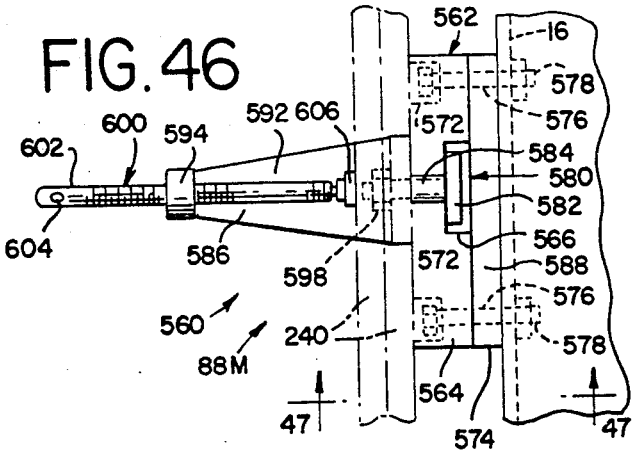
FIG. 46 is a top plan view of a side clamp.
Figure 47:
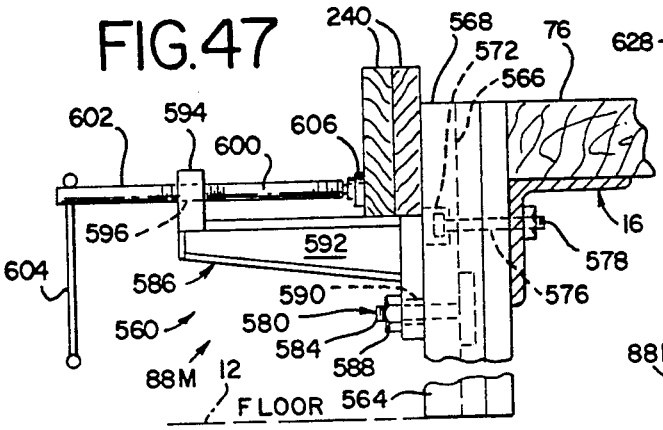
FIG. 47 is a cross sectional view taken along lines 47—47 of FIG. 46.

Another implement 88M shown in FIGS. 46 and 47 is a side clamp 560. The side clamp 560 includes a post 562 which extends from the floor 12 to flush with the work surface 76. The post 562 includes a first plate 564 which includes a T-shaped slot 562 which extends from a first end 568 to a second end 570 on the first plate 564. The first plate 564 includes two counter bored chambers 572. A second plate 574 is located adjacent to the first plate 564 and is preferably laminated or otherwise attached thereto. A bore 576 extends from each chamber 572 through the first plate 564 and the second plate 574. The bores 576 are spaced apart the distance X. The plates 564 and 574 are attached to the frame 16 by fasteners 578 which extend through any adjacent bores 56. A fastener 580 having a plate 582 and a threaded stud 584 attached to and extending from the plate 582, is slidably located within the T-shaped slot 566 such that the threaded stud 584 projects beyond the second plate 564. The fastener 580 is movable along the T-shaped slot 566 to any desired position. A bracket 586 includes a mounting plate 588 which includes an aperture 590. A shank 592 extends from the mounting plate 588 and an arm 594 having a threaded aperture 596 is attached to the shank 592. The threaded stud 584 of the fastener 580 extends through the aperture 590 of the mounting plate 588 to attach the bracket 586 to the post 562 with a nut 598. A press 600 includes a threaded rod 602 which extends through the threaded aperture 596. The threaded rod 602 includes a handle 604 slidably engaged at one end and a foot 606 pivotally connected at the other end. A workpiece 240 may be clamped against the post 562 by the press 600. The bracket 586 and press 600 may be moved to any position along the slot 566 as desired. More than one side clamp 560 may be used in connection with the workbench 10 at any one time. The side clamps 560 may be located along and attached to the frame 16 between any adjacent apertures 56.

Figure 48:
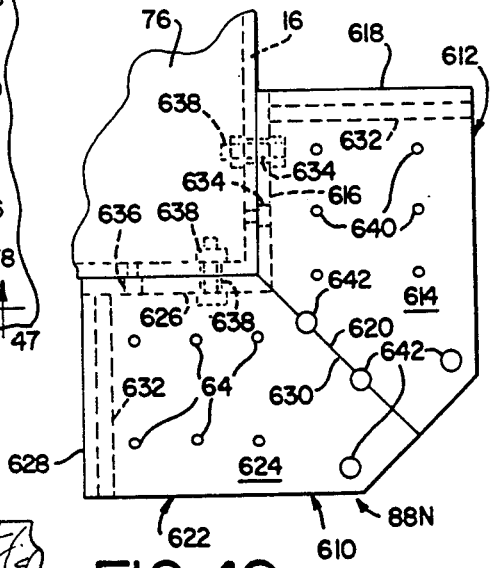
FIG. 48 is a top plan view of a corner bracket.

Another implement 88N as shown in FIG. 48 is a corner bracket 610. The corner bracket 610 includes an angle 612 having a horizontal leg 614 and a vertical leg 616. The first angle 612 extends between a first end 618 and a second end 620. The corner bracket 610 also includes a second angle 622 having a horizontal leg 624 and a vertical leg 626. The second angle 622 extends between a first end 628 and a second end 630. The second end 620 of the first angle 612 is connected to the second end 630 of the second angle 622 such that the first angle 612 is at a right angle to the second angle 622 as shown in FIG. 48. A stiffener plate 632 extends between the horizontal leg 614 and the vertical leg 616 of the first angle 612 at the first end 618. A second stiffener plate 632 extends between the horizontal leg 624 and the vertical leg 626 of the second angle 622 at the first end 628. The vertical leg 616 includes two apertures 634 which are slotted horizontally and which are spaced apart a distance Y. The vertical leg 626 includes two apertures 636 which are slotted horizontally and which are spaced apart by distance Y. The corner bracket 610 is removably fastened to any corner 41 of the frame 16 with fasteners 638 which extend through the apertures 634 and 636 of the corner bracket 610 and through the apertures 60 and 62 in the frame 16. The apertures 634 and 636 in the corner bracket 610 are located such that the horizontal legs 614 and 624 will be flush with the work surface 76 of the top panel 74. The horizontal legs 614 and 624 may include various patterns of apertures 640 and 642 to facilitate the attachment of various accessories such as vises or blocks of wood. The corner 610 will allow 270° access to a workpiece attached thereto as the bracket 610 is located at a corner 41.

Figure 49:
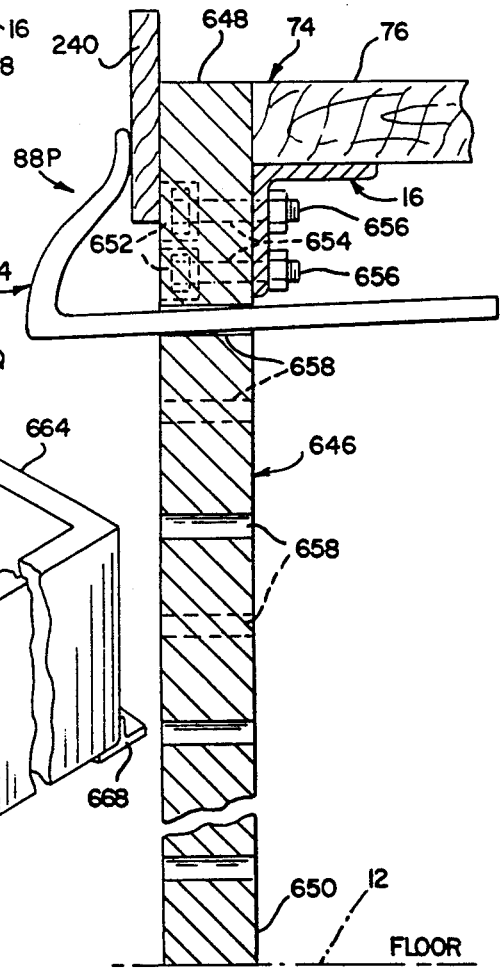
FIG. 49 shows a hold fast clamp and a mounting post mounted to the workbench.

Another implement 88P is shown in FIG. 49 and includes a hold fast clamp 644 and a post 646. The post 646 includes an upper end 648 and a lower end 650. The upper end 648 is flush with the work surface 76 of the work top panel 74 and the lower end 650 may extend downwardly to the floor 12 or any other distance as desired. The post 646 includes two counter bored chambers 652 and two bores 654 which extend through the post 646 and into the chambers 652. The bores 654 are spaced vertically from one another the distance Y. The post 646 may be attached to the frame 16 by fasteners 656 which extend through the bores 654 and respectively through any aperture 56 and 58 in the frame 16. The post 646 includes a plurality of bores 658 which are spaced as desired between the upper end 648 and the lower end 650. The hold fast 644 is inserted through any desired bore 658 until the hold fast 644 becomes wedged therein whereby the hold fast 644 may clamp a workpiece 240 against the post 646. The post 646 may be attached to the frame 16 at the location of any aperture 56 or 58. More than one post 646 may be attached to the frame 16 at any one time. More than one hold fast 644 may also be used with each post 646.

Figure 50:
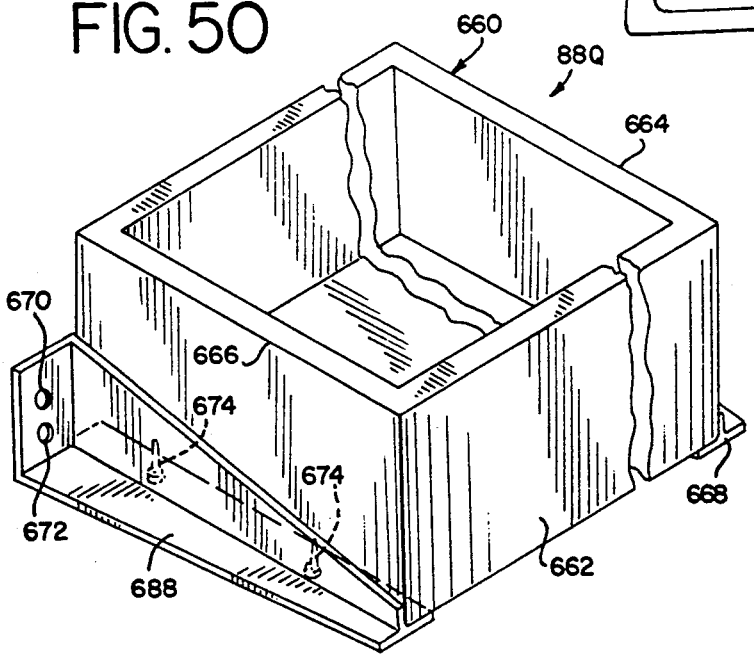
FIG. 50 is an isometric view of a tool trough.

Another implement 88Q shown in FIG. 50 is a tool trough 660 which includes an open top box 662 having a first end 664 and a second end 666. A bracket 668 is attached to each end 664 and 666 of the box 662. Each bracket 668 includes an upper aperture 670 and a lower aperture 672. The upper aperture 670 is located above the lower aperture 672 by a distance Y. The length of the tool trough 660, or the distance between the first end 664 and the second end 666, may be adjusted as desired such that the distance between the upper apertures 670 of each bracket 668 will be a multiple of the distance X. The brackets 668 are attached to the box 662 with screws 674. The tool trough 660 may be removably attached at any location along the frame 16 by fasteners which extend through the apertures 670 and 672 and through the apertures 56 and 58 in the frame 16. The tool trough 660 may be moved to various locations around the bench 10 as the location of the work which is taking place moves. The tool trough 660 may be used to hold tools or to collect sawdust, wood shavings or other debris which is swept from the work surface 76.

Another implement 88R an example of which is shown as a bench grinder in FIG. 23, is a variety of different types of power tools, such as a table top saw, planer, joiner, drill press and the like, all of which may be removably attached to the base 14. The power tools include integral clips and brackets which allow the power tools to be securely attached to the base 14 through the apertures 56 and 58.

Various features of the invention have been particularly shown and described in connection with the illustrated embodiments of the invention, however, it must be understood that these particular arrangements merely illustrate, and that the invention must be given its fullest interpretation within the terms of the appended claims.

What is claimed is:

1. A workbench for mounting an implement thereon, the workbench comprising:

a top having a work surface, a peripheral edge and an attachment surface, said attachment surface being spaced apart from said work surface, said work surface being smooth, flat and imperforate; and a base including a frame and a stand, said frame being removably attached to said attachment surface and supporting said top, said stand being attached to and supporting said frame, said frame including a plurality of rails and a plurality of independent attachment means disposed in each of said rails for removably mounting an implement to said frame, said stand including a plurality of attachment means for removably mounting at least one implement to said stand, each said attachment means comprising a plurality of spaced apart apertures, and the attachment means of the stand including horizontally opening spaced apart apertures, said attachment means allowing a plurality of implements to be adjustably positioned along and supported by said base independently positioned along and supported by said base independently of other implements which may be mounted to said base, whereby said implements may be mounted to said base for use in connection with a work piece independently of said top.

2. The workbench of claim 1 wherein said attachment means in each said rail are substantially uniformly spaced from one another.

3. The workbench of claim 1 wherein said attachment means in said rails additionally comprises an edge of said rails.

4. A workbench comprising:

a top having a work surface, a smooth peripheral edge and an attachment surface, said work surface being smooth, flat, imperforate and spaced apart from said attachment surface;

a base including a frame and a stand, said frame being removably attached to said attachment surface and supporting said top, said stand being attached to and supporting said frame, said frame including a plurality of rails and a plurality of independent attachment means positioned along each of said rails for removably mounting at least one implement to said frame, said stand including a plurality of attachment means for removably mounting at least one implement to said stand, each said attachment means comprising a plurality of spaced apart apertures and the attachment means of the stand including horizontally opening spaced apart apertures; and at least one implement removably mountable to said base by at least one of said attachment means such that said implement may be adjustably positioned along said rails and supported by said base as desired independently of other implements which may be mounted to said base, said implement being usable in connection with work pieces located adjacent to said workbench independently of said work surface.

5. The workbench of claim 4 wherein said attachment means in each said rail are substantially uniformly spaced from one another.

6. The workbench of claim 4 wherein said attachment means in said rails additionally comprises an edge of said rails.

7. The workbench of claim 4 wherein said implement comprises a vise having means for connection to said attachment means of said base.

8. The workbench of claim 4 wherein said implement comprises a clamp having means for connection to said attachment means of said base.

9. The workbench of claim 8 wherein said clamp comprises a beam and a plurality of screws, each said screw being mountable to said base.

10. The workbench of claim 8 wherein said clamp comprises a cross beam supported by two spaced apart posts and at least one press attached to said cross beam, said posts being mountable to said base.

11. The workbench of claim 8 wherein said clamp comprises a post rotatably mountable to said base, a radially extending arm slidably attached to said post and a press attached to said arm.

12. The workbench of claim 8 wherein said clamp comprises a shank having a press attached at one end.

13. The workbench of claim 12 wherein said attachment means of said clamp comprises at least one outwardly extending stud.

14. The workbench of claim 12 wherein said attachment means of said clamp comprises a hook.

15. The workbench of claim 12 wherein said clamp is rotatable about the longitudinal axis of said shank.

16. The workbench of claim 8 wherein said clamp comprises an arm mounted to said base, said arm extending across said work surface of said top, and a press mounted to said base and extending adjacent said arm.

17. The workbench of claim 8 wherein said clamp comprises a post mounted to said base, said post including a slot, and a press attached to said post, said post being slidable along said slot.

18. The workbench of claim 8 wherein said clamp comprises a post mounted to said base, said post including a plurality of bores, and a hold fast selectively extending through one of said bores.

19. The workbench of claim 4 wherein said implement comprises a bracket having means for connection to said attachment means of said base.

20. The workbench of claim 4 wherein said implement comprises a trough having means for connection to said attachment means of said base.

21. The workbench of claim 4 wherein said implement comprises a power tool having means for connection to said attachment means of said base.

* * * * *